United States Patent [19]

de Polo

[11] 4,401,041

[45] Aug. 30, 1983

[54] APPARATUS FOR MAKING HELICALLY WOUND TUBULAR ARTICLES

[76] Inventor: Harry R. de Polo, 480 Park Ave., New York, N.Y. 10022

[21] Appl. No.: 256,043

[22] Filed: Apr. 21, 1981

[51] Int. Cl.[3] ..... D05B 33/00

[52] U.S. Cl. ..... 112/63; 156/431; 493/299

[58] Field of Search ..... 112/63, 121.15; 493/299; 156/195, 193, 429, 431

[56] References Cited

U.S. PATENT DOCUMENTS

| | | | |
|---|---|---|---|
| 3,448,707 | 6/1969 | Thomsen | 112/63 |
| 4,012,272 | 3/1977 | Tiner | 156/429 |
| 4,198,916 | 4/1980 | de Polo | 112/63 |

*Primary Examiner*—Louis Rimrodt

*Assistant Examiner*—Andrew M. Falik

*Attorney, Agent, or Firm*—Robert E. Burns; Emmanuel J. Lobato; Bruce L. Adams

[57] ABSTRACT

Apparatus for making tubular articles formed of a length of material wound in helical form with contiguous edges of successive convolutions of the material joined with one another comprises a forming section made up of a plurality of guide rollers supported by a vertical arch-type frame so as to define a generally cylindrical configuration. Feed rollers propel a strip of material in a lengthwise direction through the arch of the frame and around the support provided by the guide rollers in a helical path with edges of successive convolutions of the helix abutting one another. As the material is thus in effect coiled into helical form, a sewing machine joins contiguous edges of successive convolutions to form a continuous tubular article.

12 Claims, 4 Drawing Figures

APPARATUS FOR MAKING HELICALLY WOUND TUBULAR ARTICLES

FIELD OF INVENTION

The present invention relates to apparatus for manufacturing helically wound tubular articles formed by winding one or more strips of material in a helical manner and joining contiguous edges of successive convolutions of the helix and, in particular, garments for men, women, and children. Such garments may be "dress-type" garments such as dresses, slips, blouses, coats, jackets, nightgowns, hostess coats, shirts, and other sheath-type garments for covering or partially covering the torso and, in some cases, the legs of a wearer, or may be "pants-type" garments such as pants, slacks, jeans, culottes, shorts, and similar garments for covering the lower portion of the torso and individually covering or partially covering the legs of a wearer.

BACKGROUND OF INVENTION

In my U.S. Pat. No. 4,097,933 there are disclosed garments formed essentially of one or more strips of fabric material wound helically about an axis with contiguous edges of successive convolutions of the helix joined, for example, by stitching. This patent discloses dress-type garments and also pants-type garments made in this manner. Such garments have the advantages that they can be made in a simple and economical manner and, moreover, the strip or strips forming the garment can be cut from available widths of fabric with a minimum of waste.

In my U.S. Pat. No. 4,198,916 there are disclosed a process and apparatus for making garments for one or more helically wound strips. As disclosed in this patent, strips of material which are fed from a supply roll are propelled helically around a cylindrical form with edges of adjacent convolutions of material contiguous with one another, and the contiguous edges of the material are joined together to form a continuous tubular structure.

SUMMARY OF THE INVENTION

The present invention is directed to apparatus which is operable to carry out the process described in U.S. Pat. No. 4,198,916 and is similar to the apparatus disclosed in such patent, but which embodies further improvements. In accordance with the present invention, apparatus for making tubular articles formed of a length of material wound into helical form comprises forming means composed of an arch-type frame and a plurality of elongate supports projecting from one side of the frame and arranged to define a generally cylindrical configuration. Means is provided for feeding the strip or band of material in a lengthwise direction to the forming means through the arch of the frame and around the elongate supports in a helical path, with edges of successive convolutions of the helix abutting one another. Moreover, means is provided for joining the contiguous edges of successive convolutions of the helically wound material to form a continuous tubular article.

The apparatus may also include means for joining two or more strips of material together to form a composite strip which is thereupon fed to the forming means. The apparatus may further include programmed cutting means positioned in advance of the forming means.

BRIEF DESCRIPTION OF DRAWINGS

The nature, objects, and advantages of the invention will be more fully understood from the following description of a preferred embodiment of the apparatus shown by way of example in the following drawings in which.

DESCRIPTION OF PREFERRED EMBODIMENTS

Figure 1:
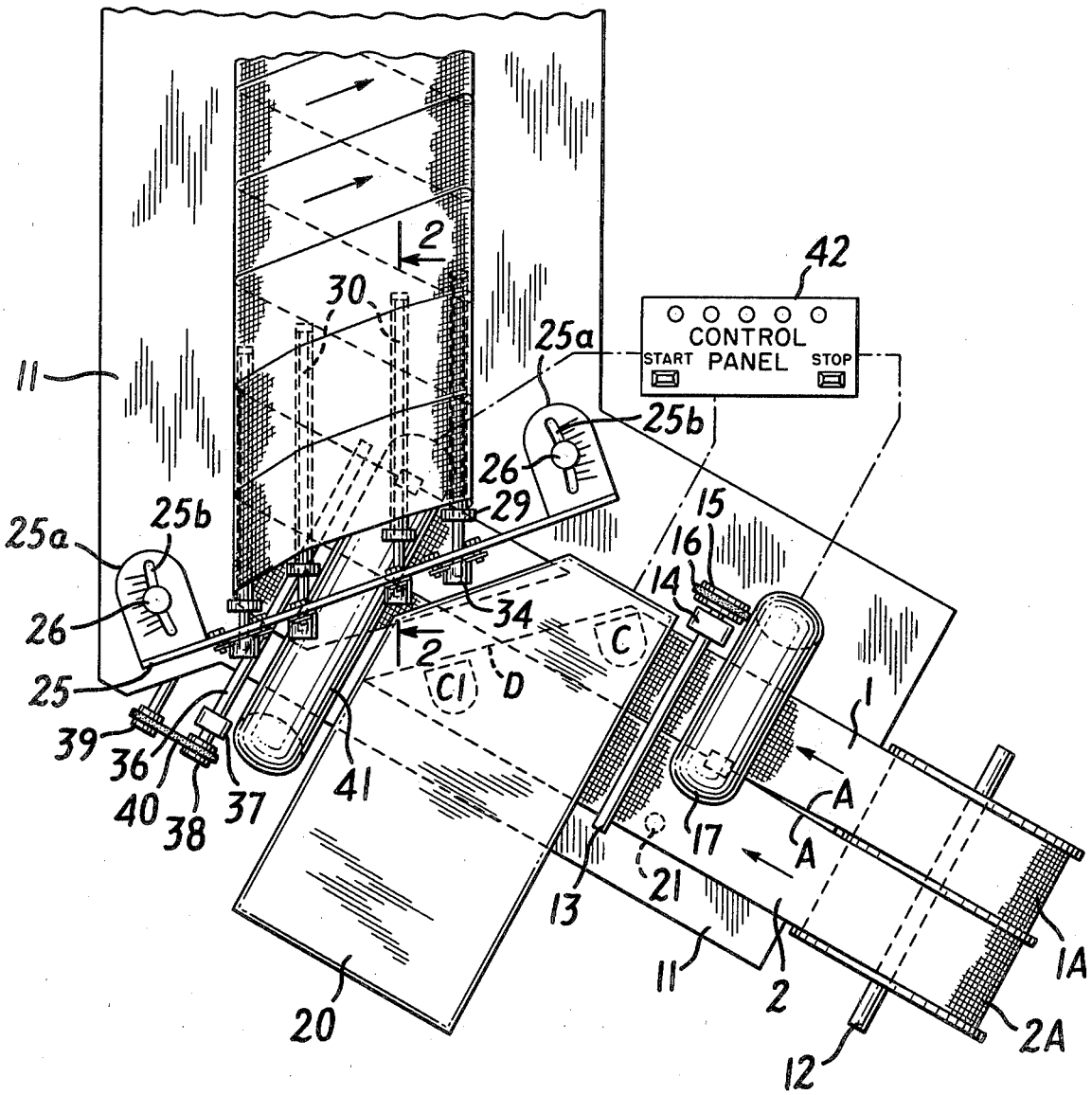
FIG. 1 is a somewhat schematic plan view of apparatus in accordance with the invention.

Except for the differences which will be pointed out, the apparatus of the present invention is in general the same as that of U.S. Pat. No. 4,198,916, the disclosure of which is herein incorporated by reference. As in the aforesaid patent, the apparatus comprises a work surface 11, onto which two strips of material 1 and 2 are fed side by side from reels 1A and 2A, respectively, which are rotatably supported by a shaft 12. The material is drawn onto a work surface 11 by upper and lower elongate puller rolls 13, disposed respectively above and below the material so as to grip the material between them. It will be understood that the lower roll is hidden by the upper roll and hence does not show in FIG. 1. The puller rolls are driven in opposite directions through a gear box 14, the input of which comprises a pulley 15 driven by a belt 16 from a suitable motor or drive shaft (not shown).

As the strips of material 1 and 2 are drawn over the work surface 11 by the puller rolls 13, adjacent edges A of the strips are joined to one another so as to form a composite strip. The means for joining the edges of the strips 1 and 2 is shown schematically in FIG. 1 as a sewing machine 17 which unites the edges by a continuous seam. The sewing machine 17 may be of a type that joins the edges of the strips with one another in overlapping relation or of a type that joins the two edges in abutting relations. As both types of sewing machines are well known, the sewing machine has been illustrated only schematically. Other types of joining, such as welding or heat sealing, may also be used.

The puller rolls 13 forward the composite strip of material to a programmed automatic cutting machine 20 which is programmed so as to cut the fabric along an inclined edge D, and also to provide armhole cutouts C and C1. The cutting may be effected in any appropriate manner; for example, by means of a knife, laser beam or high pressure water jet. The cutting machine 20 is controlled by a sensing device 21 which measures the fabric as it is propelled by the puller rods 13 and controls the cutting machine so as to cut the material to suitable length for the articles produced. Alternatively, the control may be effected by sensing the rotation of the puller rolls 13. As automatic programmed cutting machines are well-known, such machine is shown only schematically in the drawings.

From the cutting machine 20, the composite strip is advanced to means for forming the composite strip into a helix and joining contiguous edges of adjacent convolutions of the helix so as to form a tubular structure. Such means is illustrated schematically in the drawings as comprising an arch-type frame 25, shown as a vertical plate having feet portions 25*a* by which it is mounted on the table support 11 by means of bolts 26. It will be seen that the frame is disposed at an angle of about 55 degrees to the feed path of the composite strip. Moreover, the bolts 26 extend through arcuate slots 25*b* in the feet portions 25*a* of the frame, so that the angle of the frame can be varied and the frame thereupon secured in selected position. Calibrations are provided adjacent the slots 25*b* so as to indicate the position in which the frame is set. As will be seen in FIG. 3, the frame 25 is provided with an arch or opening 25*c*, through which the composite strip passes and which accommodates associated equipment, as will be described.

Figure 2:
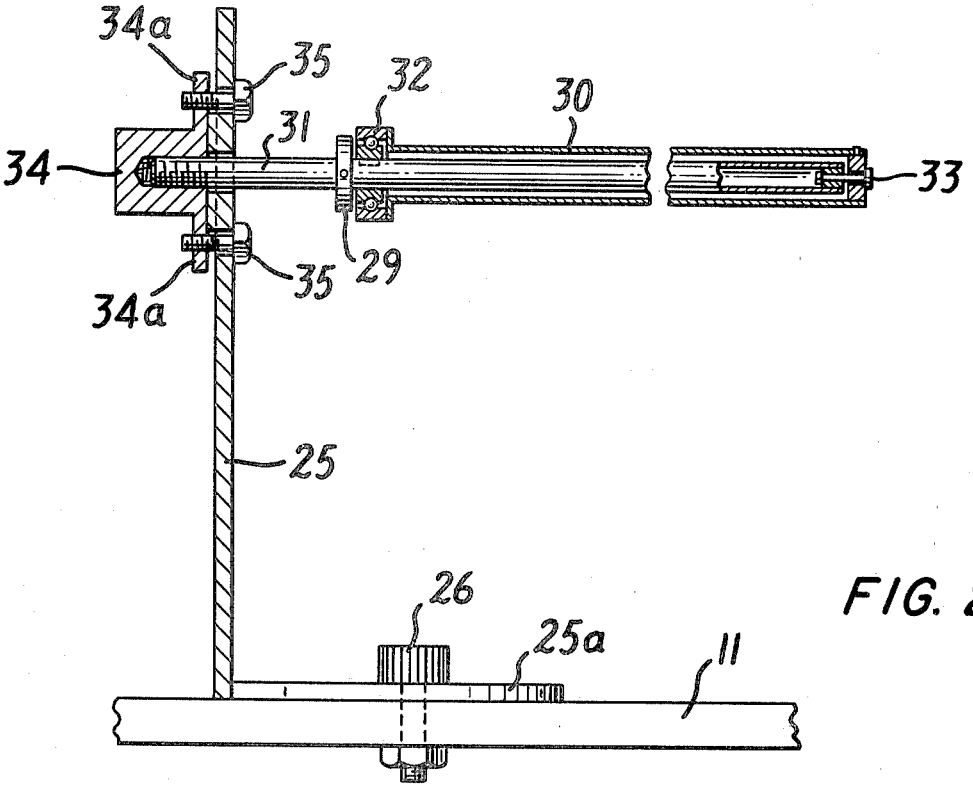
FIG. 2 is a vertical section taken approximately on the line 2—2 in FIG. 1.

As will be seen in FIG. 1, a plurality of elongate supports 30 project from one side of the frame 25. The construction of the supports is illustrated by way of example in FIG. 2, where it will be seen that each support 30 comprises a roller rotatably supported on a shaft 31 by a ball bearing 32 at one end of the roller and a bearing pin 33 at the outer end of shaft 31. The roller 30 is positioned axially of the shaft by means of a collar 29 and by a head on the bearing pin 33.

Figure 3:
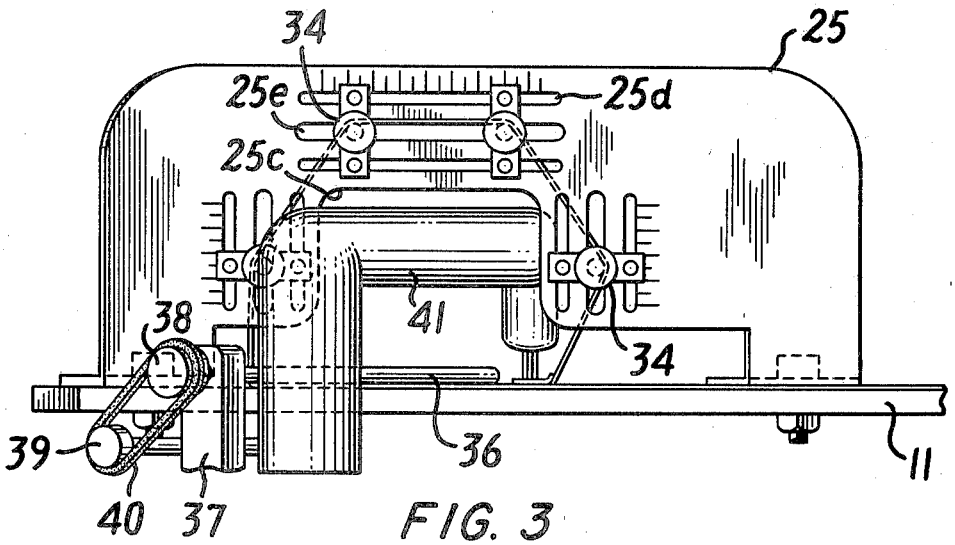
FIG. 3 is a front elevation of a portion of the apparatus for winding a strip of material in helical form and joining contiguous edges of successive convolutions of the helically wound material.

Each of the shafts 31 is mounted in selected position on the frame 25 by means of a mounting fixture 34 into which a threaded end of the shaft 31 is screwed. The fixture 34 has opposite flanges 34*a* having tapped holes into which bolts 35 are screwed. The bolts 35 extend through elongate slots 25*d* in the frame 25, while a central slot 25*e* accommodates the shaft 31. Calibrations seen in FIG. 3 are preferably provided along one of the slots. In this manner, the position of the supports 30 can be varied as desired, whereupon the supports are secured in selected position by tightening the bolts 35.

As seen in FIGS. 1 and 3, the roller supports 30 are arranged in the general configuration of a cylinder projecting from the rear face of the frame 25. However, these supports do not project at right angles to the frame, but rather at selected angle which is shown by way of example as approximately seventy degrees. This angle is determined by the fittings 34. While one or more of the rollers 30 may be driven if so desired, it is usually sufficient merely to provide for their free rotation on the shafts 31.

The material coming from the cutting apparatus 20, or from the feed rollers 13 in the event that cutting apparatus is not used, is propelled to and around the forming apparatus by means of upper and lower feed rollers 36 driven by a gear box 37 having an input pulley 38 driven from a drive pulley 39 by a belt 40. The strip of material is thereby propelled along a helical path defined by the rollers 30. A leading edge of the strip may be directed by hand around the supporting rollers to assist in starting the formation of a helix. Thereafter, the helical formation of the fabric will continue to be propelled around the supporting rollers 30 by the feed rollers 36 which, as will be seen in FIG. 1, extend through the arch of the frame 25 so as to engage at least one convolution of the helix. If the cutting equipment 20 is employed to cut the strip into predetermined lengths, it may be desirable to leave small portions of successive lengths attached so that the helix formed of the strip will, in effect, be continuous. This avoids the necessity of guiding the leading edge of each length manually.

As the composite strip is thus formed into a helix, contiguous edges of successive convolutions of the helix are joined so as to produce the tubular structure. Means for joining the edges is shown schematically as a sewing machine 41 which extends through the arch 25*c* of the frame 24 and into the inside of the helix formed on the rollers 30 in position to join the edges of the material which has been formed into a helix. The sewing machine 41, like the sewing machine 17, may be of any suitable type. The contiguous edges of the fabric are thereby stitched together, for example, in overlapping or abutting relationship. As in the case of the rollers 13, rollers 36 are located shortly downstream of the sewing machine and are coordinated with the usual feed mechanism of the sewing machine so as to keep the material smooth and flat throughout its width.

At the downstream end of the form defined by the rollers 30 the material is discharged onto the table surface 11 or elsewhere, as desired. It will be recognized that when the apparatus is used to produce garments, the article produced comprises, for example, the body portion of a dress-type garment requiring only the insertion of sleeves (if sleeves are desired) and the finishing of the neckline and hemline to complete a finished garment.

In order to produce different size garments, it is necessary only to adjust the positions of the rollers 30 as described above so as to define, in effect, a larger or smaller "cylinder" by the position of the rollers. Moreover, the cutting machine 20 is suitably programmed to provide proper garment length and armhole or other cutouts as required for the particular garments to be produced. The same or similar apparatus can also be used for producing sleeves and trouser legs by selecting the proper positions of the rollers 30 or by using fewer than all of the rollers.

Figure 4:
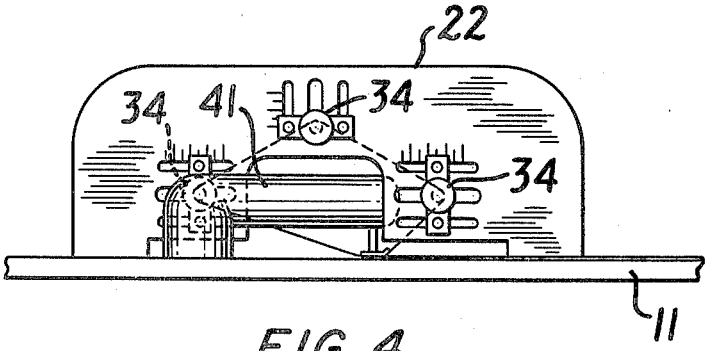
FIG. 4 is a simplified front elevation on a smaller scale, illustrating a modification.

Moreover, in FIG. 4, there is shown similar apparatus in which only three supporting rollers are shown mounted on the frame 25. Moreover, the slots for adjusting the rollers are differently arranged. Thus, the slots for the slide rollers extend horizontally while the slots for the upper roller extend vertically.

All components of the apparatus, including feed rollers 13 and 36, the sewing machines 17 and 41, and the cutting machine 20 are controlled by a central control panel 42 so that the operation of all components is coordinated. The control panel is provided with suitable start and stop buttons and includes suitable protective circuitry.

While preferred embodiments of the apparatus have been shown by way of example in the drawings, it will be understood that such apparatus is susceptible of variations and modifications, and that the invention is thus in no way limited to the illustrated embodiments.

Thus, for example, the mandrel frame and the rollers of the forming means may be made of different materials such as metal, plastic, or wood. Moreover, the apparatus can be used to produce a wide variety of articles other than garments.

What I claim is:

1. Apparatus for making tubular articles formed of a length of material wound into helical form and having contiguous edges of successive convolutions of said material joined with one another, said apparatus comprising forming means comprising an open frame and a plurality of parallel elongate supports projecting from one side of said frame and arranged to define a generally cylindrical configuration means for feeding said material in a lengthwise direction to said forming means, through the opening of said frame and around said supports in a helical path with edges of successive convolutions of the helix abutting with one another, and means for joining said contiguous edges of successive convolutions of said material to form a continuous tubular article.

2. Apparatus according to claim 1, in which each of said supports comprises a shaft fixed to and projecting from said frame and a roller rotatable on said shaft.

3. Apparatus according to claim 1, in which said feeding means includes means for feeding said material along a straight path to said forming means and in which said frame is disposed at an acute angle to said feed path, means being provided for varying the angle of said frame and for securing said frame in selected position.

4. Apparatus according to claim 1, in which said joining means comprises means extending through the opening of said frame with a joining head positioned inside the cylindrical configuration defined by said elongate supports.

5. Apparatus according to claim 4, in which said feeding means includes a driven roller extending through the opening of said frame and engaging said material to propel it forwardly around said forming means.

6. Apparatus according to claim 1, further including programmed cutting means positioned in the path of travel of said material in advance of said forming means.

7. Apparatus according to claim 6, comprising central control means for coordinating the operation of said feeding means, cutting means, forming means, and joining means.

8. Apparatus according to claim 1, further including, in advance of said forming means, means for joining two or more strips of material to form a composite strip.

9. Apparatus according to claim 1, in which means is provided for changing the position of said elongate supports on said frame and for securing said supports in selected position.

10. Apparatus according to claim 1, further comprising means defining a work surface and means securing said frame in selected position on said work surface.

11. Apparatus according to claim 10, in which said frame is in the form of an arch having feet portions secured to said work surface defining means.

12. Apparatus according to claim 11, in which said feet portions have slots therein, said securing means comprising bolts extending through slots.

* * * * *